US012091215B2

(12) United States Patent
Palladino et al.

(10) Patent No.: US 12,091,215 B2
(45) Date of Patent: Sep. 17, 2024

(54) LID-SPOUT ASSEMBLY FOR A PACKAGE, METHOD FOR PRODUCING A LID-SPOUT ASSEMBLY AND PACKAGE HAVING A LID-SPOUT ASSEMBLY

(71) Applicant: Tetra Laval Holdings & Finance S.A., Pully (CH)

(72) Inventors: Daniele Palladino, Scandiano (IT); Maurizio Filippini, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 17/923,580

(22) PCT Filed: May 21, 2021

(86) PCT No.: PCT/EP2021/063622
§ 371 (c)(1),
(2) Date: Nov. 6, 2022

(87) PCT Pub. No.: WO2021/239608
PCT Pub. Date: Dec. 2, 2021

(65) Prior Publication Data

US 2023/0182964 A1 Jun. 15, 2023

(30) Foreign Application Priority Data

May 27, 2020 (EP) ..... 20176807

(51) Int. Cl.
*B65D 5/74* (2006.01)
*B65D 25/46* (2006.01)

(52) U.S. Cl.
CPC ..... *B65D 25/465* (2013.01); *B65D 5/746* (2013.01)

(58) Field of Classification Search
CPC ..... B65D 5/746; B65D 5/563; B65D 47/103; B65D 47/0847; B65D 2401/15; B65D 25/465
(Continued)

(56) References Cited

U.S. PATENT DOCUMENTS 3,145,872 A * 8/1964 Hayes ..... B65D 55/16 220/375
4,795,065 A * 1/1989 Ashizawa ..... B65D 47/0838 220/832
(Continued)

FOREIGN PATENT DOCUMENTS

EP 2361743 A1 8/2011
EP 2495185 A1 9/2012
(Continued)

OTHER PUBLICATIONS

International Search Report mailed Aug. 19, 2021, for priority International Patent Application No. PCT/EP2021/063622.

*Primary Examiner* — Charles P. Cheyney
(74) *Attorney, Agent, or Firm* — Renner, Otto, Boisselle & Sklar, LLP

(57) ABSTRACT

A lid-spout assembly for a package intended to contain a pourable product and having a main body including a designated pour opening through which the pourable product can be poured, in use; the lid-spout assembly including a spout having a pouring outlet fluidly connectable with the designated pour opening; and a lid configured to be coupled to the spout to selectively close and open the pouring outlet; the spout including: a base frame configured to couple the spout to the main body about the designated pour opening and having a first wall configured to face, in use, the inner space of the main body, and a collar carrying the pouring
(Continued)

outlet and protruding from the base frame; the base frame including a plurality of recesses obtained on the first wall.

12 Claims, 3 Drawing Sheets

(58) Field of Classification Search
USPC ..... 222/541.9, 556, 541.5, 566, 528; 220/375, 258.2, 258.5
See application file for complete search history.

(56) References Cited

U.S. PATENT DOCUMENTS 4,909,434 A * 3/1990 Jones ..... B29C 66/7392 220/258.2
4,986,465 A * 1/1991 Jacobsson ..... B65D 5/727 229/125.09
5,176,300 A * 1/1993 Kishikawa ..... B29C 66/61 222/541.9
5,799,840 A * 9/1998 Mogard ..... B65D 47/0842 222/541.9
5,934,496 A * 8/1999 Mogard ..... B65B 7/2878 220/837
6,402,019 B1 * 6/2002 Casale ..... B65D 41/3495 53/329.2
6,626,315 B2 * 9/2003 Lees ..... B65B 3/025 229/125.09
8,899,442 B2 * 12/2014 Muramoto ..... B65D 47/36 220/784
9,309,041 B2 * 4/2016 Mabee ..... B65D 47/0814
11,724,864 B2 * 8/2023 Corradi ..... B65D 47/088 220/277
2004/0035883 A1 * 2/2004 Schellenberg ..... B65D 5/746 222/541.9

FOREIGN PATENT DOCUMENTS

EP 3257771 A1 12/2017
GB 2233315 A 1/1991

* cited by examiner

LID-SPOUT ASSEMBLY FOR A PACKAGE, METHOD FOR PRODUCING A LID-SPOUT ASSEMBLY AND PACKAGE HAVING A LID-SPOUT ASSEMBLY

TECHNICAL FIELD

The present invention relates to a lid-spout assembly for a package, in particular a package obtained by folding and sealing a sheet of packaging material and intended to contain a pourable product, preferably a pourable food product.

The present invention also relates to a package, in particular a package obtained by folding and sealing a sheet of packaging material and intended to contain a pourable product, preferably a pourable food product, and comprising a lid-spout assembly.

The present invention further relates to a method for molding a lid-spout assembly on a sheet of packaging material for producing a package, in particular a package obtained by folding and sealing a sheet of packaging material and intended to contain a pourable product, preferably a pourable food product.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated sheet of packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Such packages are normally produced in fully automatic packaging assemblies, in which a continuous tube is formed from a web or sheet of packaging material formed by a plurality of base units joined together and unwound from a reel and subsequently fed to such packaging assembly. Each base unit is intended to form a respective package. The sheet of packaging material is sterilized in the packaging assembly, e.g. by applying a chemical sterilizing agent, such as hydrogen peroxide solution, which, once sterilization is completed, is removed from the surfaces of the packaging material, e.g. evaporated by heating. The sheet so sterilized is then maintained in a closed, sterile environment, and is folded and sealed longitudinally to form the tube, which is fed along a vertical advancing direction.

In order to complete the forming operations, the tube is filled with the sterilized food product from above and is sealed and subsequently cut along equally spaced transversal cross-sections by a known forming and sealing unit.

Pillow packs are obtained thereby, one from each base unit of the sheet of packaging material, which have a longitudinal sealing band, a top transversal sealing band and a bottom transversal sealing band.

The known packaging assemblies typically comprise a folding unit configured to be fed with the pillow packs to form fully-folded finished packages.

To open the packages described above, various solutions have been proposed, which involve the use of opening devices, generally defined by lid-spout assemblies made of plastic material.

According to a widespread solution, lid-spout assemblies are known to be molded, by injection molding, directly on a hole, in particular a through hole formed at a predetermined area of the sheet of packaging material through the full thickness of the packaging material.

In other words, the molten plastic material is molded at the hole to cover and close the hole in a fluid-tight manner.

The known packages generally comprise a sealed main body having a designated pour opening, defined by the aforementioned hole, and a lid-spout assembly arranged on the main body about the designated pour opening and configured to allow for a controlled outpouring of the pourable product.

The lid-spout assembly typically comprises a spout having a pouring outlet and a lid removably coupled to the spout so as to selectively close and open the pouring outlet.

The spout comprises a base frame for coupling the spout to the main body about the designated pour opening and a collar carrying the pouring outlet, in particular internally defining a flow channel for the pourable product ending with the pouring outlet, and protruding from the base frame.

According to a known solution, in order to avoid any unwanted littering, the lid-spout assembly also comprises a tethering element connecting the lid and the spout to one another.

It is known that after the process of punching the sheet of packaging material to form the hole thereon, the lateral wall of the hole defined by the thickness of the packaging material is devoid from the layer of heat-seal plastic material. Thus, the base layer would be directly exposed to the pourable product at the lateral wall of the hole, if uncovered. It is therefore important to cover such lateral wall, or at least the part thereof defined by the base layer, with the plastic material of the lid-spout assembly during the process of molding the lid-spout assembly to the sheet of packaging material.

In some applications, packages are obtained from a thin sheet of packaging material, hence, in this case, the thickness of the packaging material is reduced. This can lead to an increased flexibility of the packaging material which can compromise the nominal flow of molten plastic material during the molding process of the lid-spout assembly on the packaging material.

Even though the known lid-spout assemblies work satisfyingly well, a need is felt in the sector to further improve such lid-spout assemblies, in particular so as to further ensure that at least the part of the lateral wall of the hole defined by the base layer, in particular the entire lateral wall of the hole, is properly and fully covered by the plastic material of the lid-spout assembly.

DISCLOSURE OF INVENTION

It is therefore an object of the present invention to provide in a straightforward and low-cost manner an improved lid-spout assembly for a package, in particular a package obtained by folding and sealing a sheet of packaging material and intended to contain a pourable product, preferably a pourable food product.

This object is achieved by a lid-spout assembly as claimed in claim 1.

It is a further object of the present invention to provide in a straightforward and low-cost manner a package, in particular a package having a sealed main body, filled with a pourable product, in particular filled with a pourable food product, having the above-mentioned lid-spout assembly.

This object is achieved by a package as claimed in claim 9.

It is a further object of the present invention to provide in a straightforward and low-cost manner a method for molding a lid-spout assembly on a sheet of packaging material for producing a package, in particular a package obtained by folding and sealing the sheet of packaging material and intended to contain a pourable product, preferably a pourable food product.

This object is achieved by a method for molding a lid-spout assembly on a sheet of packaging material as claimed in claim 11.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
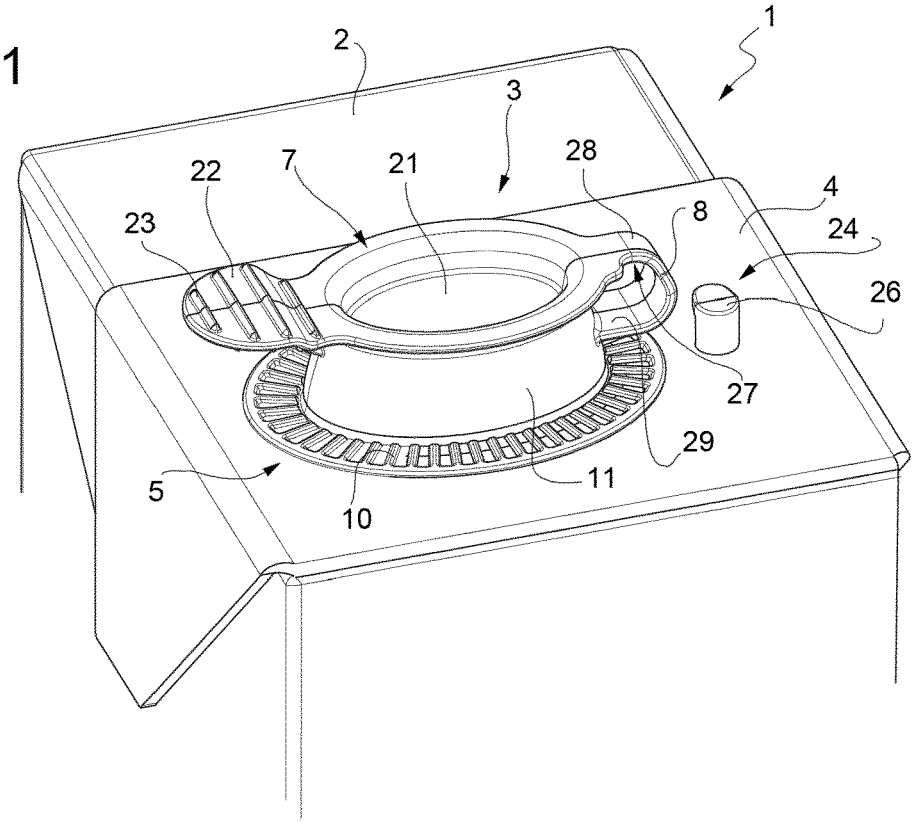
FIG. 1 is a schematic perspective view of a package having a lid-spout assembly according to the present invention and being in a first configuration, with parts removed for clarity.
Figure 2:
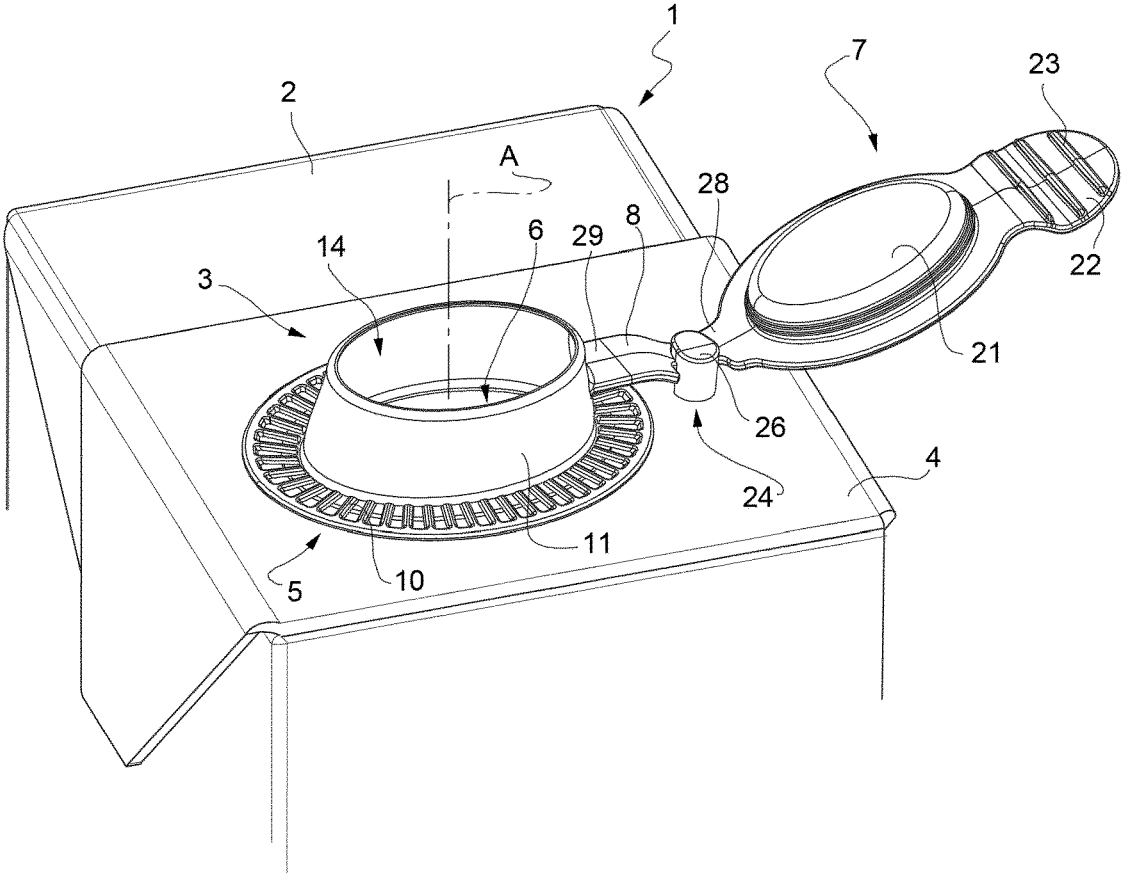
FIG. 2 is a schematic perspective view of the package of FIG. 1 with the lid-spout assembly being in a second configuration, with parts removed for clarity.

With reference to FIGS. 1 and 2, number 1 indicates as a whole a package configured to contain a pourable product, preferably a pourable food product such as pasteurized or UHT milk, water, fruit juice, wine, etc., and produced starting from a sheet of packaging material.

Package 1 comprises:

- a (sealed) main body 2 intended to be filled with a pourable product, in particular a pourable food product, and having a designated pour opening (not shown and known per se) configured to allow an outflow of the pourable product from main body 2; and
- a lid-spout assembly 3 coupled to main body 2, arranged and/or arrangeable about the designated pour opening and configured to allow for a controlled outpouring of the pourable product from main body 2, in particular so that a consumer can consume the pourable product directly through lid-spout assembly 3 and/or from package 1.

Preferably, package 1 is designed for the consumption on-the-go, i.e. the consumer can consume the pourable product directly from package 1 without the need of any intermediate means such as drinking glasses, drinking cups or similar.

Preferably, lid-spout assembly 3 is designed for the consumption on-the-go, i.e. the consumer can consume the pourable product directly through lid-spout assembly 3.

Preferably, package 1 is produced by means of a packaging machine (not shown) configured for continuously producing packages 1 starting from respective base units of packaging material which are initially joined together in a continuous web or sheet unwound off a storage reel.

In detail, main body 2 is obtained by forming a tube from the sheet of packaging material, by longitudinally sealing the tube, by filling the tube with the pourable product and by transversally sealing, forming and cutting the tube.

Pillow packs are thereby obtained which are then fed to a folding unit for the final folding thereof.

According to this non-limiting embodiment, the packaging material has a multilayer structure (not shown), and comprises a layer of fibrous material, e.g. paper, covered on both sides with respective layers of heat-seal plastic material, e.g. polyethylene.

In the case of aseptic packages 1 for long-storage products, such as UHT milk, the packaging material also comprises a layer of gas-and-light barrier material, e.g. aluminum foil or ethylene vinyl alcohol (EVOH) film, which is superimposed on a layer of heat-seal plastic material, and is in turn covered with another layer of heat-seal plastic material, the latter forming the inner face of the package 1 eventually contacting the pourable product.

After being unwound off the storage reel, the sheet of packaging material is provided with a plurality of lid-spout assemblies 3, in particular one for each base unit and then is preferably sterilized, e.g. by applying a chemical sterilizing agent, such as hydrogen peroxide solution, which, once sterilization is completed, is removed from the surfaces of the packaging material, e.g. evaporated by heating.

According to the preferred embodiment shown, the lid-spout assemblies 3 are made of plastic material which is injection-molded onto each base unit by means of known molding devices (not shown).

According to some non-limiting embodiments, such molding devices are arranged downstream of the storage reel and upstream of a sterilization unit for sterilizing the sheet of packaging material, along a forming path of packages 1.

In practice, lid-spout assemblies 3 are applied to the base units of packaging material in form of sheet, i.e. prior to sterilizing the sheet of packaging material and prior to arranging the sheet of packaging material within, or during advancement of the sheet of packaging material through, the packaging machine for forming, filling and sealing main bodies 2 starting from the sheet of packaging material carrying lid-spout assemblies 3.

In greater detail, each lid-spout assembly 3 is applied, i.e. molded, on a hole 50 (FIG. 3), in particular a through hole formed at a predetermined area of the sheet of packaging material through the full thickness of the packaging material.

In other words, the molten plastic material is molded at hole 50 to cover and close in a fluid-tight manner hole 50.

The aforementioned hole defines, once the base unit has been formed into a main body 2, the designated pour opening of the main body 2 itself.

Preferably, main body 2 is parallelepiped-shaped.

Conveniently, the designated pour opening is arranged in a top wall 4 of main body 2. Hence, lid-spout assembly 3 is arranged on such top wall 4, once package 1 is finally obtained.

According to an alternative embodiment not shown, another wall other than top wall 4, for example a lateral wall, of main body 2 carries and/or comprises the designated pour opening.

Package 1, in particular main body 2, delimits an inner space configured to contain the pourable product.

Figure 3:
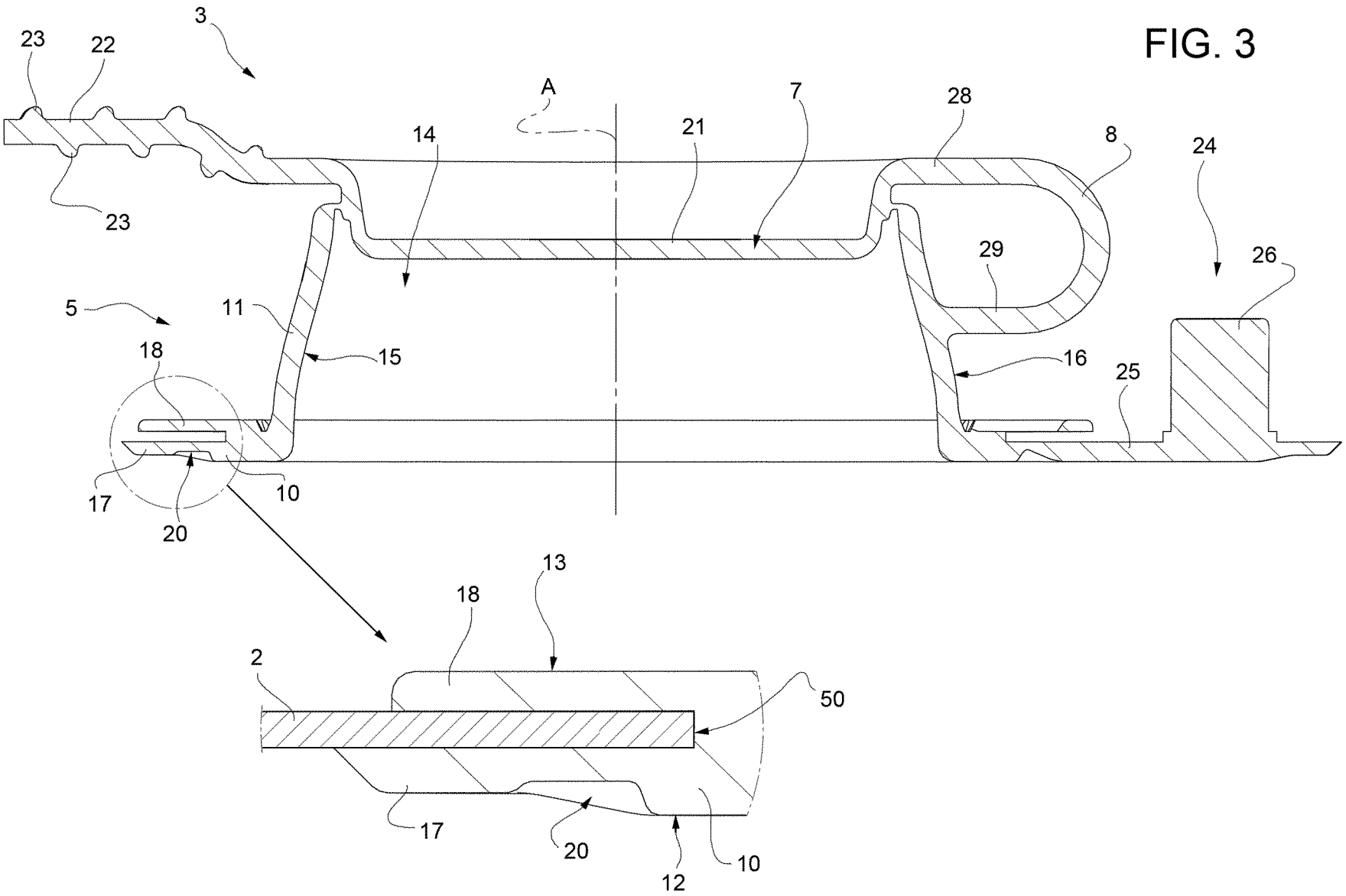
FIG. 3 is a larger-scale, partially sectioned side view of the lid-spout assembly in the first configuration, with parts removed for clarity.

With particular reference to FIGS. 1 to 3, lid-spout assembly 3 comprises:

a spout 5 connectable to main body 2 about the designated pour opening, i.e. configured to be molded to the sheet of packaging material about hole 50, and having a pouring outlet 6 (FIG. 2) fluidly connectable with the designated pour opening and, therefore, configured to allow for a (controlled) outflow of the pourable product from the spout 5 itself (and, therefore, from main body 2 and/or from package 1);

a lid 7 coupled to spout 5 and configured to selectively close and open pouring outlet 6; and a tethering element 8 tethering, in particular permanently tethering, and/or coupling lid 7 to spout 5.

In particular, tethering element 8 prevents any unwanted littering originating from lid 7 being decoupled or separated from, and therefore being disposable separately from, spout 5 and package 1.

According to the described preferred non-limiting embodiment, spout 5 comprises:

a base frame 10 configured to couple spout 5 to main body 2, in particular to top wall 4, about the designated pour opening; and a collar 11 carrying (comprising) pouring outlet 6 and fixed to base frame 10.

Figure 4:
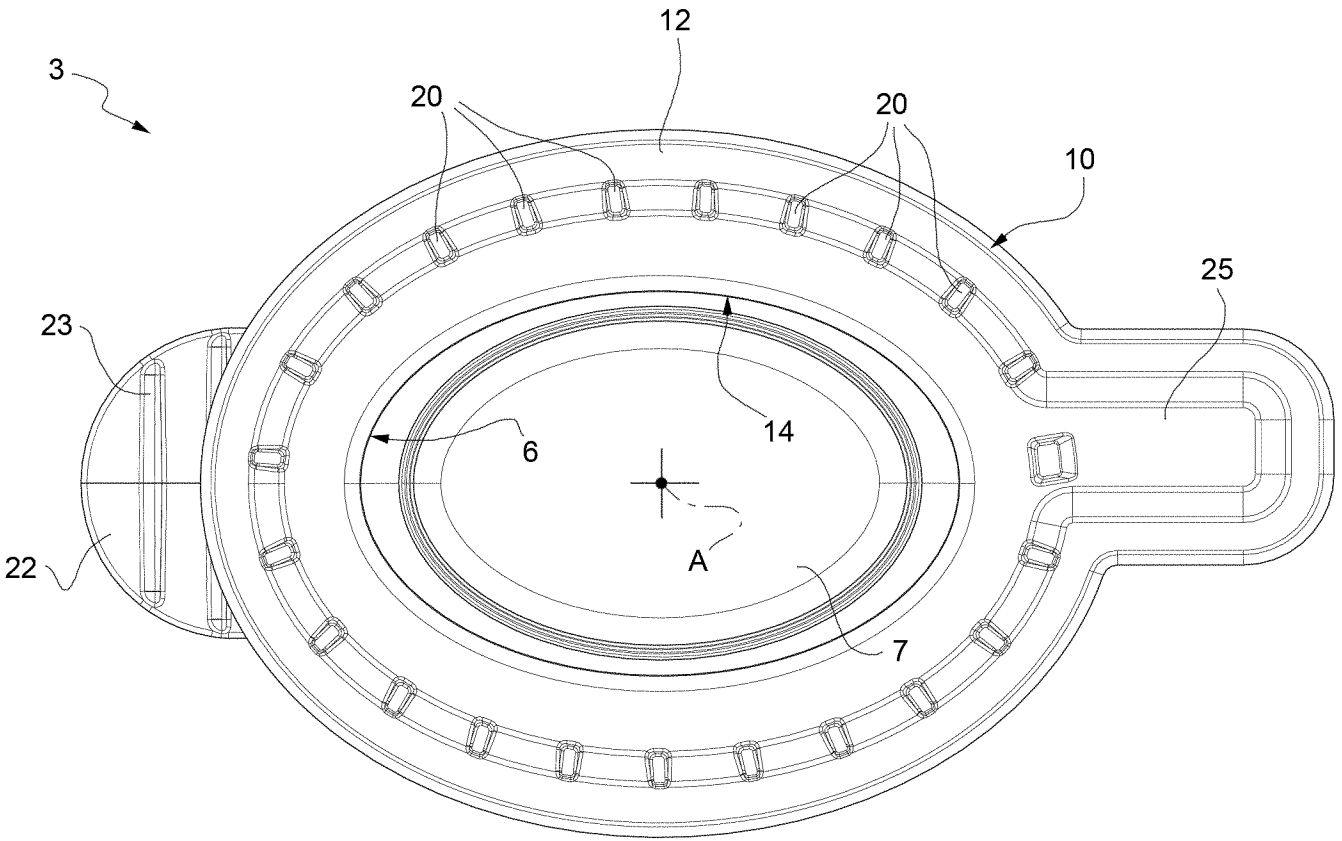
FIG. 4 is a larger-scale bottom view, with parts removed for clarity, of the lid-spout assembly in the first configuration.

More precisely, with particular reference to FIGS. 3 and 4, base frame 10 comprises a first wall 12 configured to face, in use, the inner space of main body 2 and a second wall 13 opposite to first wall 12.

In practice, first wall 12 defines an internal wall of base frame 10 possibly intended to be contacted in use by the pourable product, once lid-spout assembly 3 is coupled to main body 2, and second wall 13 defines an external wall of base frame 10, configured to be arranged at the exterior of package 1.

As visible in FIGS. 1, 2 and 3, collar 11 protrudes from base frame 10, in particular from second wall 13 of base frame 10, and internally defines (i.e. laterally delimits) a flow channel 14 for the pourable product having a longitudinal axis A and axially ending, at a free end thereof, with pouring outlet 6.

In particular, flow channel 14 is fluidly connected or connectable with the designated pour opening, i.e. with hole 50, so as to allow the outflow of the pourable product through pouring outlet 6 when lid 7 is removed from collar 11.

Preferably, collar 11 comprises an inner surface 15 delimiting flow channel 14 and an outer surface 16 opposite to inner surface 15.

Preferably, collar 11 has a tubular configuration.

Preferably, collar 11 has an annular cross-sectional profile with respect to a cross-sectional plane perpendicular to axis A. In particular, the cross-sectional profile has an oval shape. Alternatively, the cross-sectional profile could have a circular or square or elliptical or rectangular shape.

According to this preferred non-limiting embodiment, collar 11 is designed such to allow a consumer to drink directly from spout 5, in particular from collar 11.

Lid 7 is controllable between:

a closed position (FIGS. 1, 3 and 4) in which lid 7 is configured to engage pouring outlet 6 so as to close pouring outlet 6 for preventing an outflow of the pourable product out of flow channel 14; and an open position (FIG. 2) in which lid 7 is detached from pouring outlet 6 for allowing an outflow of the pourable product out of flow channel 14 and through pouring outlet 6.

Conveniently, package 1 is, immediately after its formation, in an initial configuration in which lid 7 is in the closed position. Package 1 is distributed and/or sold to a consumer while being in the initial configuration.

According to this non-limiting preferred embodiment, lid 7 comprises a main portion 21 and a gripping element 22 protruding, in particular laterally protruding, from main portion 21, and configured to allow the consumer to grip gripping element 22 itself and to move lid 7 between the closed position and the open position. In particular, gripping element 22 comprises ribs 23 improving the gripping properties of gripping element 22.

According to some preferred non-limiting embodiments, lid 7 is rupturably fixed to collar 11, in particular prior to the first time lid 7 is controlled from the closed position to the open position. In particular, lid 7 is rupturably fixed to collar 11 in an irreversible manner.

In detail, prior to the first time lid 7 is controlled from the closed position to the open position, lid 7 is rupturably fixed to collar 11 along an irreversibly rupturable interface, in particular the irreversibly rupturable interface having an annular shape. In particular, lid 7 is rupturably fixed to collar 11 so as to seal flow channel 14 (and as a consequence the inner space of main body 2) from an outer environment.

Thus, after the first time lid 7 is controlled from the closed position to the open position, it is again possible to control lid 7 in the closed position and to establish contact between lid 7 and collar 11, but lid 7 is not fixed to collar 11 anymore.

According to some embodiments, lid 7 and spout 5 are formed, in particular molded, preferably simultaneously molded, in a single piece without solution of continuity.

According to some preferred non-limiting embodiments, spout 5, lid 7 and tethering element 8 are molded, in particular simultaneously molded, from a polymer and preferably in a single piece without solution of continuity.

In particular, lid-spout assembly 3 is directly molded on the packaging material about the designated pour opening, by means of the above-mentioned molding device.

As visible in FIG. 3, base frame 10 comprises a first annular portion 17 and a second annular portion 18 axially spaced from one another with respect to axis A, first annular portion 17 carrying first wall 12 and second annular portion 18 carrying second wall 13.

In detail, lid-spout assembly 3 is molded on hole 50 so that a portion of the sheet of packaging material, in particular the portion of the relative base unit surrounding hole 50, is interposed, in particular axially interposed, between first annular portion 17 and second annular portion 18.

In greater detail, such portion of the base unit, which surrounds hole 50, and therefore the designated pour opening of main body 2, is housed within an interstice axially delimited by first annular portion 17 and second annular portion 18.

More precisely, first annular portion 17 comprises a first engagement surface configured to contact an inner surface of main body 2 and second annular portion 18 comprises a second engagement surface configured to contact an outer surface of main body 2, the inner surface facing the inner space of main body 2. In particular, the first engagement surface and the second engagement surface face one another through the above-mentioned interstice.

It is known that during punching of the sheet of packaging material to obtain hole 50, a lateral wall of hole 50 defined by the thickness of the packaging material is devoid from the layer of heat-seal plastic material. Thus, the base layer of the packaging material would be directly exposed, in use, to the pourable product at the lateral wall of hole 50 if this latter were uncovered. It is therefore important that at least the part of such lateral wall closest to the inner space of main body 2, in particular at least the part of the lateral wall defined by the base layer, preferably the entire lateral wall, is covered with the plastic material of lid-spout assembly 3 during the process of molding.

Advantageously, base frame 10 comprises a plurality of recesses 20 obtained on first wall 12.

In particular, recesses 20 are arranged around axis A. More in particular, recesses 20 are distributed in an equally-spaced manner around axis A.

More in particular, recesses 20 are arranged around pouring outlet 6, in particular are distributed in an equally-spaced manner around pouring outlet 6.

More precisely, recesses 20 are distributed on first wall 12 in an equally-spaced manner around an intersection portion between collar 11 and base frame 10.

As visible in FIGS. 3 and 4, each recess 20 extends from first wall 12 towards second wall 13, within first annular portion 17.

In other words, each recess 20 is defined by a blind hole obtained in first annular portion 17.

According to this non-limiting preferred embodiment, each recess 20 has a substantially rectangular profile.

In detail, each recess 20 comprises a substantially rectangular back wall and an endless lateral wall extending from the back wall and joined to first wall 12.

In greater detail, the back wall is substantially parallel to first wall 12.

Recesses 20 are obtained during molding of lid-spout assembly 3 on the sheet of packaging material.

In particular, the above-mentioned molding device is configured to be coupled to the sheet of packaging material at hole 50 so as to define a mold cavity surrounding hole 50 and, therefore, housing a portion of the packaging material.

More in particular, the molding device comprises at least two molding tools (known per se and not shown) configured to close against one another on the packaging material on opposite sides thereof, namely the inner surface and the outer surface thereof.

Each molding tool has a main wall delimiting partially the mold cavity and configured to face one respective side of the sheet of packaging material.

Conveniently, the molding tool facing the inner surface of the packaging material, which delimits the inner space of main body 2 once main body 2 is formed, comprises a plurality of protrusions (not shown) extending from the main wall and facing, at least during injection of the molten plastic material into the mold cavity, the inner surface of the packaging material.

In particular, the interaction between the protrusions and the inner surface of the packaging material ensures that during the molding process the distance between the main wall of the molding tool and the inner surface is greater than a predetermined value, i.e. ensures that such distance is at least substantially equal to the height of the protrusions with respect to the main wall.

In light of the above, each protrusion will produce one respective recess 20 on first wall 12 of base frame 10 of spout 5 once the molding process is completed.

Thanks to the presence of recesses 20, and more in particular thanks to the protrusions, the main wall of the molding tool can be distanced from the inner surface of the packaging material.

This configuration ensures a nominal flow of the molten plastic material into the mold cavity, on the inner surface of the packaging material and about the hole 50.

The Applicant has advantageously observed that such configuration ensures that at least the part of the lateral wall of hole 50 defined by the base layer, in particular at least the part of the lateral wall closest to the inner space of main body 2, more in particular the entire lateral wall, is fully covered by the molten plastic material during the molding process.

Thus, even for those applications in which the thickness of the packaging material is reduced, which can lead to an increased flexibility of the packaging material, a nominal flow of molten plastic material during the molding process is ensured.

According to some preferred non-limiting embodiments, lid spout-assembly 3 further comprises a retaining group 24 configured to interact with tethering element 8 and/or lid 7 for (at least) temporarily retaining lid 7 in the open position. In particular, "temporarily retaining" means that the interaction is such that tethering element 8 and/or lid 7 can be disengaged from retaining group 24 again.

In particular, tethering element 8 is designed to be (temporarily) coupled to retaining group 24 for retaining lid 7 in the open position.

Preferably, lid spout-assembly 3 further comprises a connection base 25 fixed to and protruding, in particular laterally protruding away, from base frame 10 and carrying retaining group 24. In particular, connection base 25 is substantially parallel to base frame 10.

In particular, connection base 25 is connected to first annular portion 17, even more particular laterally protrudes from first annular portion 17.

Preferably, retaining group 24 comprises a hook element 26 configured to interact with tethering element 8 for retaining lid 7 in the open position.

Preferably, hook element 26 transversally, in particular perpendicularly, extends from connection base 25.

Opportunely, tethering element 8 comprises a recess 27 configured to engage retaining group 24, in particular hook element 26, so as to temporarily fix lid 7 in the open position.

According to this non-limiting preferred embodiment, tethering element 8 comprises a first end 28 fixed to lid 7 and a second end 29, in particular opposite to first end 28, fixed to collar 11.

Preferably, tethering element 8 is fixed to outer surface 16 of collar 11.

Even more preferably, tethering element 8 is fixed to a central portion of collar 11.

In particular, first end 28 is connected to main portion 21. More precisely, first end 28 is connected to a first zone of main portion 21 and gripping element 22 is connected to a second zone of main portion 21 opposite to the first zone.

According to some preferred non-limiting embodiments, tethering element 8 presents a curved shape, in particular a curved U-shape, when lid 7 is in the closed configuration, and presents a S-shape when lid 7 is in the open configuration (and in particular when lid 7 and/or tethering element 8 interact with retaining group 24).

In use, the outpouring of the pourable product from package 1 requires controlling lid 7 from the closed position to the open position so as to open pouring outlet 6.

When lid 7 is controlled in the open position, tethering element 8 is conveniently coupled to retaining group 24 so that lid 7 remains in the open position.

After the termination of the outpouring, lid 7 is newly positioned in the closed position.

Tethering element 8 guarantees that lid 7 remains coupled to spout 5, thereby preventing any unwanted littering.

The advantages of lid-spout assembly 3 according to the present invention will be clear from the foregoing description.

In particular, thanks to the presence of recesses 20, and more in particular thanks to the protrusions of the molding tool, the main wall of the molding tool can be spaced from the inner surface of the packaging material.

This ensures a nominal flow of the molten plastic material on the inner surface of the packaging material and about the punched hole 50.

The Applicant has advantageously observed that such configuration ensures that at least the part of the lateral wall of hole 50 closest to the inner space of main body 2, in particular at least the part of the lateral wall defined by the base layer, preferably the entire lateral wall, is fully covered by the molten plastic material during the molding process.

Thus, even for those applications in which the thickness of the packaging material is reduced, which can lead to an increased flexibility of the packaging material, the nominal flow of molten plastic material during the molding process is ensured.

Furthermore, the above-mentioned configuration is particularly advantageous for ensuring the nominal flow of molten plastic material in case of non-circular holes 50 (e.g. oval-shaped holes).

Clearly, changes may be made to lid-spout assembly 3 as described herein without, however, departing from the scope of protection as defined in the accompanying claims.

The invention claimed is:

1. A lid-spout assembly for a package intended to contain a pourable product and having a main body comprising a designated pour opening through which the pourable product can be poured, in use; said lid-spout assembly comprising:

a spout having a pouring outlet fluidly connectable with the designated pour opening; and a lid configured to be coupled to the spout to selectively close and open the pouring outlet;

the spout comprising:

a base frame configured to couple the spout to the main body about the designated pour opening and having a first wall configured to face, in use, the inner space of the main body; and a collar carrying the pouring outlet and protruding from the base frame;

wherein the base frame comprises a plurality of recesses obtained on the first wall, and the plurality of recesses are distributed in a spaced manner around an axis of the pouring outlet; and the plurality of recesses are distributed in an equally-spaced manner along one singular path of curvature around the axis of the pouring outlet.

2. The lid-spout assembly as claimed in claim 1, wherein said recesses are distributed in an equally-spaced manner around the pouring outlet.

3. The lid-spout assembly as claimed in claim 1, wherein said collar internally defines a flow channel for the pourable product having a longitudinal axis and axially ending with said pouring outlet;

wherein said recesses are arranged around said longitudinal axis.

4. The lid-spout assembly as claimed in claim 1, wherein the base frame further comprises a second wall opposite to the first wall, and wherein each recess extends from the first wall towards the second wall.

5. The lid-spout assembly as claimed in claim 1, wherein each recess is defined by a blind hole.

6. The lid-spout assembly as claimed in claim 1, wherein the lid and the spout are connected to one another.

7. The lid-spout assembly as claimed in claim 1, wherein the lid and the spout are formed in one single piece without solution of continuity.

8. A package configured to contain a pourable product and comprising:

a main body having a designated pour opening; and a lid-spout assembly according to claim 1 and coupled to the main body at the designated pour opening.

9. The package as claimed in claim 8, wherein the package is designed for the consumption on-the-go and/or wherein the package is a single serving portion package.

10. The lid-spout assembly as claimed in claim 1, wherein the plurality of recesses are distributed in an equally-spaced manner around an intersection portion between the collar and the base frame.

11. The lid-spout assembly as claimed in claim 1, wherein each of the plurality of recesses has a rectangular profile comprising a rectangular back wall and a lateral wall extending from the back wall and joined to the first wall.

12. The lid-spout assembly as claimed in claim 1, wherein the plurality of recesses are punctuated along the path of curvature around the axis of the pouring outlet.

* * * * *